US010928020B1

(12) United States Patent
Ahmadi et al.

(10) Patent No.: US 10,928,020 B1
(45) Date of Patent: Feb. 23, 2021

(54) LIGHT BAR FOR SUSPENDED CEILING

(71) Applicant: USG Interiors, LLC, Chicago, IL (US)

(72) Inventors: Rana Ahmadi, Glendale, CA (US); Richard R. Medina, Los Angeles, CA (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 16/547,612

(22) Filed: Aug. 22, 2019

(51) Int. Cl.

| | |
|---|---|
| ***F21V 7/00*** | (2006.01) |
| ***F21S 8/04*** | (2006.01) |
| ***E04B 9/36*** | (2006.01) |
| ***F21S 8/02*** | (2006.01) |
| ***F21V 21/04*** | (2006.01) |
| *F21Y 115/10* | (2016.01) |
| *E04B 9/04* | (2006.01) |

(52) U.S. Cl.
CPC ..... *F21S 8/026* (2013.01); *F21V 21/048* (2013.01); *E04B 9/04* (2013.01); *F21Y 2115/10* (2016.08)

(58) Field of Classification Search
CPC ..... F21S 8/026; F21V 21/048; F21Y 2115/10; E04B 9/04
See application file for complete search history.

(56) References Cited

U.S. PATENT DOCUMENTS 3,536,905 A * 10/1970 Ruff ..... A61N 5/06 362/1
5,136,483 A * 8/1992 Schoniger ..... F21S 43/245 362/545
6,149,283 A * 11/2000 Conway ..... F21V 29/83 362/236
7,229,198 B2 * 6/2007 Sakai ..... G02B 6/0051 362/225
7,722,220 B2 * 5/2010 Van De Ven ..... F21V 7/005 362/294
8,000,594 B2 * 8/2011 Messina ..... F21V 7/28 396/199
8,104,923 B2 * 1/2012 Nagai ..... H01L 25/0753 362/240
8,248,459 B2 * 8/2012 Zhang ..... G02B 30/27 348/46

(Continued)

FOREIGN PATENT DOCUMENTS

JP 2016-207922 A 12/2016

OTHER PUBLICATIONS

International Search Report and Written Opinion, International Application No. PCT/US2020/046387, filed Aug. 14, 2020; dated Oct. 26, 2020.

*Primary Examiner* — Arman B Fallahkhair
(74) *Attorney, Agent, or Firm* — Pearne & Gordon LLP

(57) ABSTRACT

An elongated lighting assembly useful in suspended baffle ceilings comprising an inverted channel having an upper web and opposed legs depending from opposite sides of the web, inturned flanges extending inwardly from lower ends of the legs, distal edges of the flanges being horizontally spaced from each other to form a gap, LED tape located over an upper surface of the flanges and carrying upwardly facing LED elements at regularly spaced intervals, surfaces inside the channel facing the LED tape being coated with a white diffuse reflecting material whereby light emitted by the LED elements emanates essentially exclusively out of the gap by diffuse reflection from the coating.

3 Claims, 4 Drawing Sheets

(56) References Cited

U.S. PATENT DOCUMENTS

| | | | | |
|---|---|---|---|---|
| 8,960,966 | B2 * | 2/2015 | Ko | G02B 6/0046 362/298 |
| 9,200,761 | B2 * | 12/2015 | Hong | F21V 7/0008 |
| 10,359,163 | B1 | 7/2019 | Hettwer et al. | |
| 2009/0243455 | A1 * | 10/2009 | Biebel | F21V 29/505 313/1 |
| 2012/0236537 | A1 | 9/2012 | Pickard | |
| 2015/0241023 | A1 | 8/2015 | Kim et al. | |
| 2018/0334804 | A1 | 11/2018 | Patterson | |

* cited by examiner

LIGHT BAR FOR SUSPENDED CEILING

BACKGROUND OF THE INVENTION

The invention relates to suspended ceiling construction and, more particularly, to a novel illuminated ceiling baffle.

PRIOR ART

It is known to suspend a parallel array of baffles at ceiling height to reduce noise in the underlying space or area and/or provide an attractive ceiling boundary for the space. It is customary to illuminate an area with overhead lighting fixtures in a ceiling structure. At times, the lighting fixtures distract from the appearance of a ceiling structure by interrupting the continuity or pattern uniformity of the ceiling structure. U.S. Pat. No. 10,359,163 discloses a baffle lighting assembly that addresses these issues.

SUMMARY OF THE INVENTION

The invention provides an illuminated ceiling baffle or light bar construction that optionally can provide increased acoustical properties. The illumination elements are contained within the baffle so that the baffle exterior is largely indistinguishable from non-illuminated like baffle units. This feature allows visual uniformity to be obtained in a ceiling structure where a limited number of illuminated baffles are distributed among a number of non-illuminated baffles.

Ordinarily, in the practice of the invention illuminated and non-illuminated baffles or bars are of the same general housing construction, typically comprising elongated channels or tubes of sheet metal having walls or faces optionally with a desired pattern of perforations or holes for increased acoustical properties. The disclosed lighting assembles afford functional down lighting of a desired brightness depending on the number of lighting baffles or bars distributed throughout the ceiling area. In some versions, the inventive baffle bar can be provided with perforated walls and contain, along with a light source, a sound absorbing medium such as a porous batt of non-woven fiber.

The disclosed baffle/light bar produces a uniform pattern of visible light by diffuse reflection of light from discrete LED elements inside and spaced along the length of the bar. Stated otherwise, the light bar utilizes the concept of indirect lighting within its confines to produce a diffuse beam of light from what are the essentially point sources of the LED elements.

By diffusely reflecting light, the cost and complexity of separate light diffusing lenses is avoided. Greater flexibility in the size and shape of the light bar housing is afforded to the manufacturer and/or the interior designer since the housing need not conform to the size and shape of a lens, typically manufactured by others.

The light bar simply has its interior surfaces coated or painted with a high reflective value, diffusely reflecting material. The reflective coating does not require any specific interior surface or shape or orientation so that the light bar housing configuration can be selected or determined without extensive consideration being given to the lighting componentry.

DESCRIPTION OF THE PREFERRED EMBODIMENTS

Figure 1:
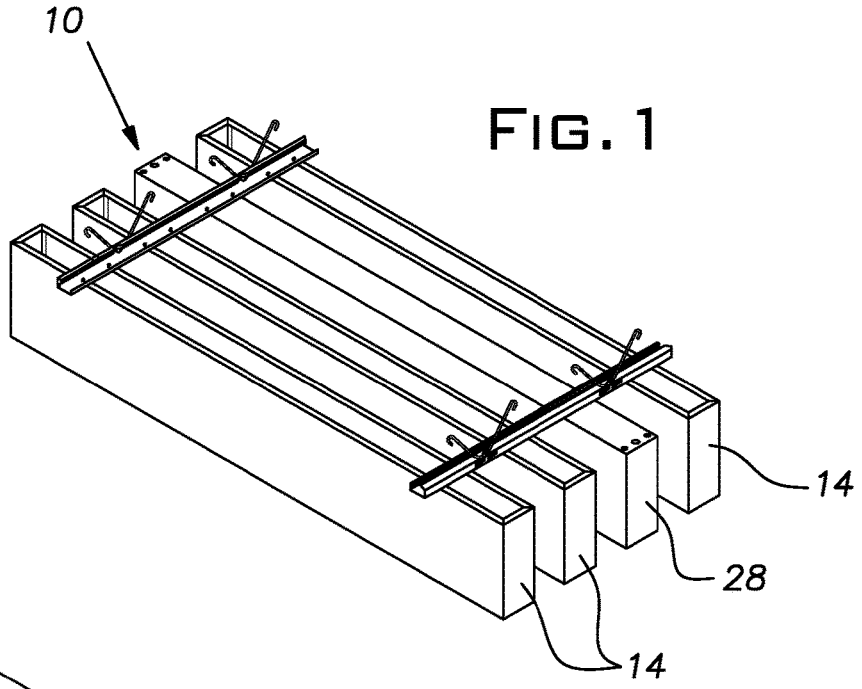
FIG. 1 is an isometric view, taken from above, of a light bar assembly of the invention assembled with acoustical baffles for use in a suspended ceiling.
Figure 2:
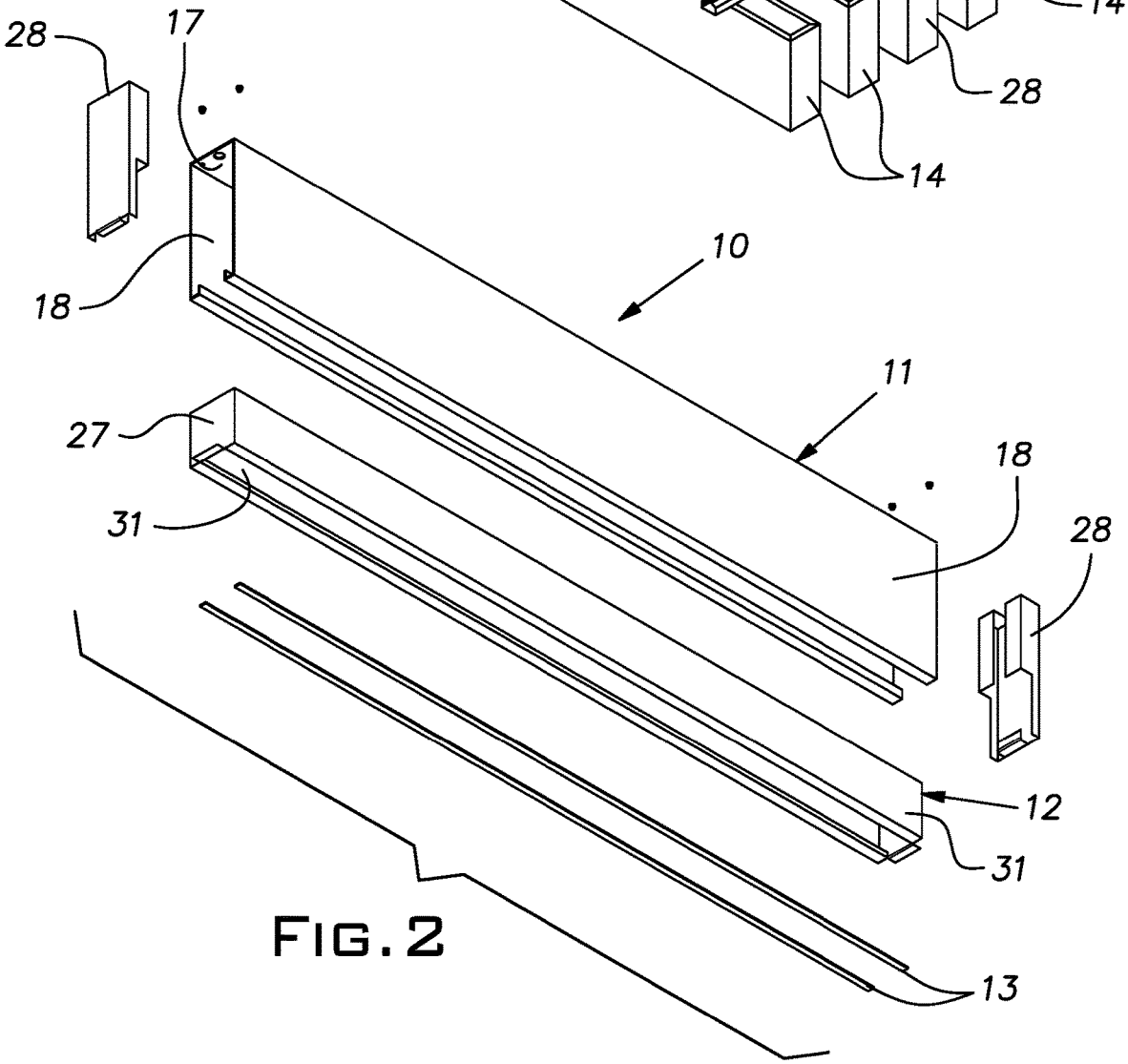
FIG. 2 is an exploded isometric view of a light bar assembly of the invention.
Figure 3:
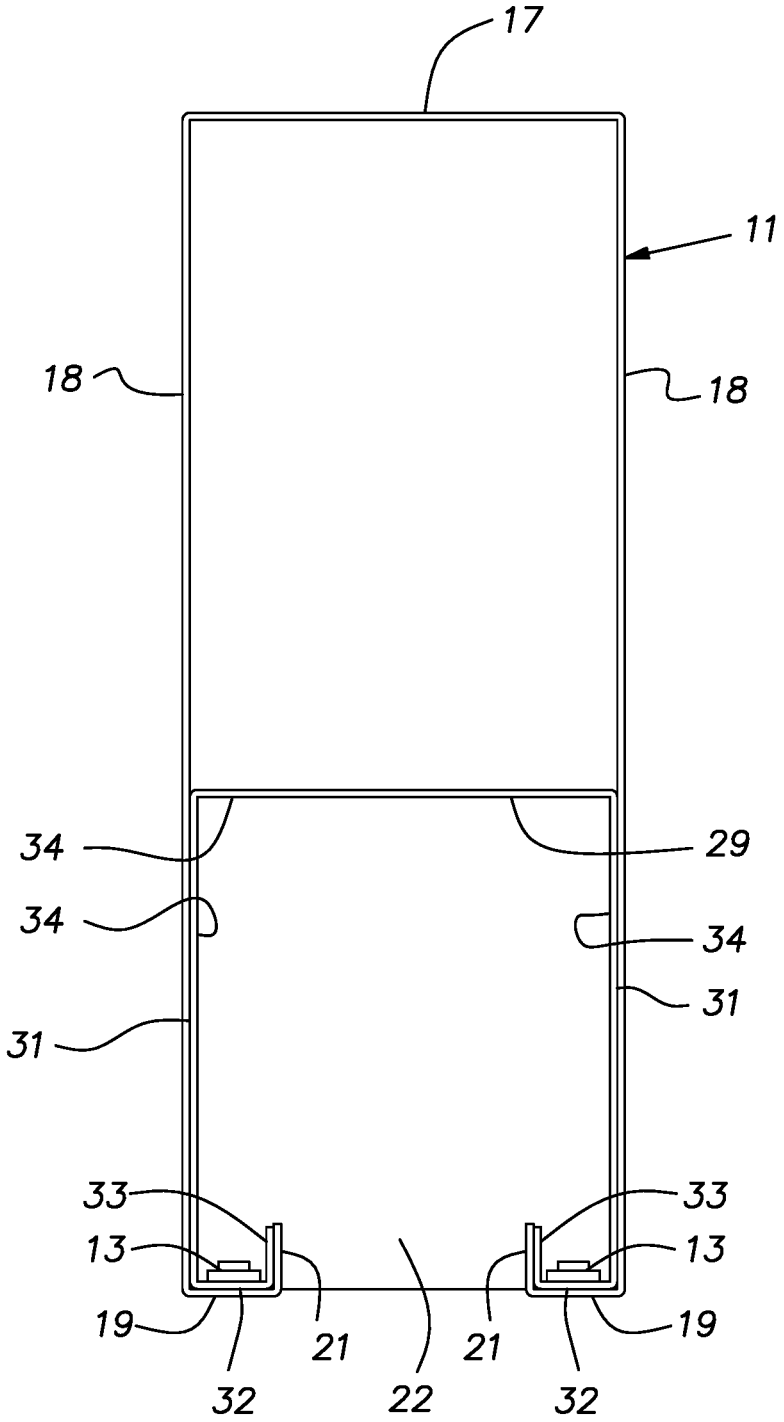
FIG. 3 is a cross-sectional view of the light bar assembly.

Referring generally to FIGS. 1-3, a light bar 10 is an assembly of primarily a housing 11, a light channel 12 and light strips 13. In the illustrated example, the housing 11 is formed of sheet metal, for example of 0.040 inch, 0.050 inch or 0.063 inch gauge aluminum fabricated into an inverted channel of rectangular cross-section. For example, nominally the housing 11 can have a width of 3 inches or less, a depth of between 6 inches-8 inches, and a length of 1 to 10 feet. Ordinarily, the external dimensions and finish of the housing 11 will match that of non-illuminated suspended ceiling baffles 14 shown in FIG. 1. The light bar 10 can be rigidly attached to the baffles 14 to form a module used with like modules to construct an open plenum suspended ceiling.

The housing 11, preferably formed from a single metal sheet, has a horizontal web or wall 17 and opposed generally vertical legs or walls 18 depending from longitudinal edges of the web 17. Lower edges of the vertical walls 18 have inwardly directed horizontal flanges 19. At inward or distal edges, the horizontal flanges 19 have upstanding vertical flanges or walls 21. The flanges 21 mutually form a gap or opening 22 of uniform width that extends along the full length of the housing 11 in the center of its bottom or lower face.

A channel 12, sometimes hereafter referred to as a light channel, is fabricated preferably of a single sheet of metal such as 0.032 inch, 0.040 inch, 0.050 inch, or 0.063 inch gauge aluminum. The illustrated light channel 12 is an inverted channel-shaped structure with a rectangular cross-section. Ends 27 of the channel 12 are closed by rectangular elements integral with the main body of the channel. The light channel 12 is sized to nest in the housing 11 with little or negligible lateral horizontal clearance. The length of the channel 12 is slightly less than that of the housing 11 to not interfere with end caps 28 fixed in respective ends of the housing 11 with suitable screws or other fasteners.

Like the housing 11, the channel 12 has a horizontal web or wall 29 and opposed depending walls or legs 31. At their bottom or free ends, the walls 31 have inturned horizontal flanges 32 and upturned vertical flanges 33 at distal edges of the horizontal flanges. The light channel 12 is proportioned so that its flanges 32, 33 are received in respective flanges 19, 21 of the housing 11.

Preferably, the housing vertical flanges 21 are sufficiently wide (high) to cover the vertical flanges 33 of the channel 12 when the channel is properly assembled in the housing 11 and the light bar 10 is viewed from below. The housing vertical flanges 21 are also sufficiently high to block any direct light from the LED tape through the gap 22. In the illustrated example, the vertical dimension (height/depth) of the light channel 12 is less than one-half that of the housing 11.

The interior surfaces of the light channel 12 are preferably coated with a high reflective value material, white in color, of preferably at least 90% light reflectance value (LRV) and more preferably of about 93% LRV or more and that reflects diffusely without "hot spots" or glare. This coating material, indicated at 34, is typically applied to a face of the sheet before it is fabricated into the light channel 12.

The light strips or LED tape 13 such as a product FLEX DC® 44 marketed by optic Arts® of Monterrey Park, Calif. USA is adhered, LED elements face up, to top surfaces of each of the light channel horizontal flanges 32 along the full length of the light channel 12. As is typical, the discrete LEDs (light emitting diodes) are regularly spaced (e.g. at centers spaced 0.65 inch) along the length of the tape 13. The tapes 13 are suitably supplied with electrical power, e.g. 24 volt DC.

Light emanating from the LEDs of the tape 13 is reflected by the coating 34 on the inner walls of the light channel 12 and passes through the gap 22 between the flanges 21. Because of the upwardly facing orientation of the LEDs on the tape 13 and the height of the flanges 21, 33, being preferably at least as high as the top surface of the tape 13, all of the visible light passing through the gap 22 is diffuse reflected light and is absent any "hot spots", glare, or specular reflection. More specifically, at least one of the flanges 21, 33 on both sides of the gap 22 should be high enough relative to the associated tape 13 to obstruct any direct light beam through the gap 22. Note that apart from the gap 22, the light channel 12 is closed so that any light energy escaping from the light channel is constrained to pass through the gap 22. Moreover, any such escaping light is indirectly received by reflection from the LED strips or tapes 13. The result is a uniform beam of diverse light rays emanating from the interior of the light channel 12 through the opening or gap 22.

Figure 4:
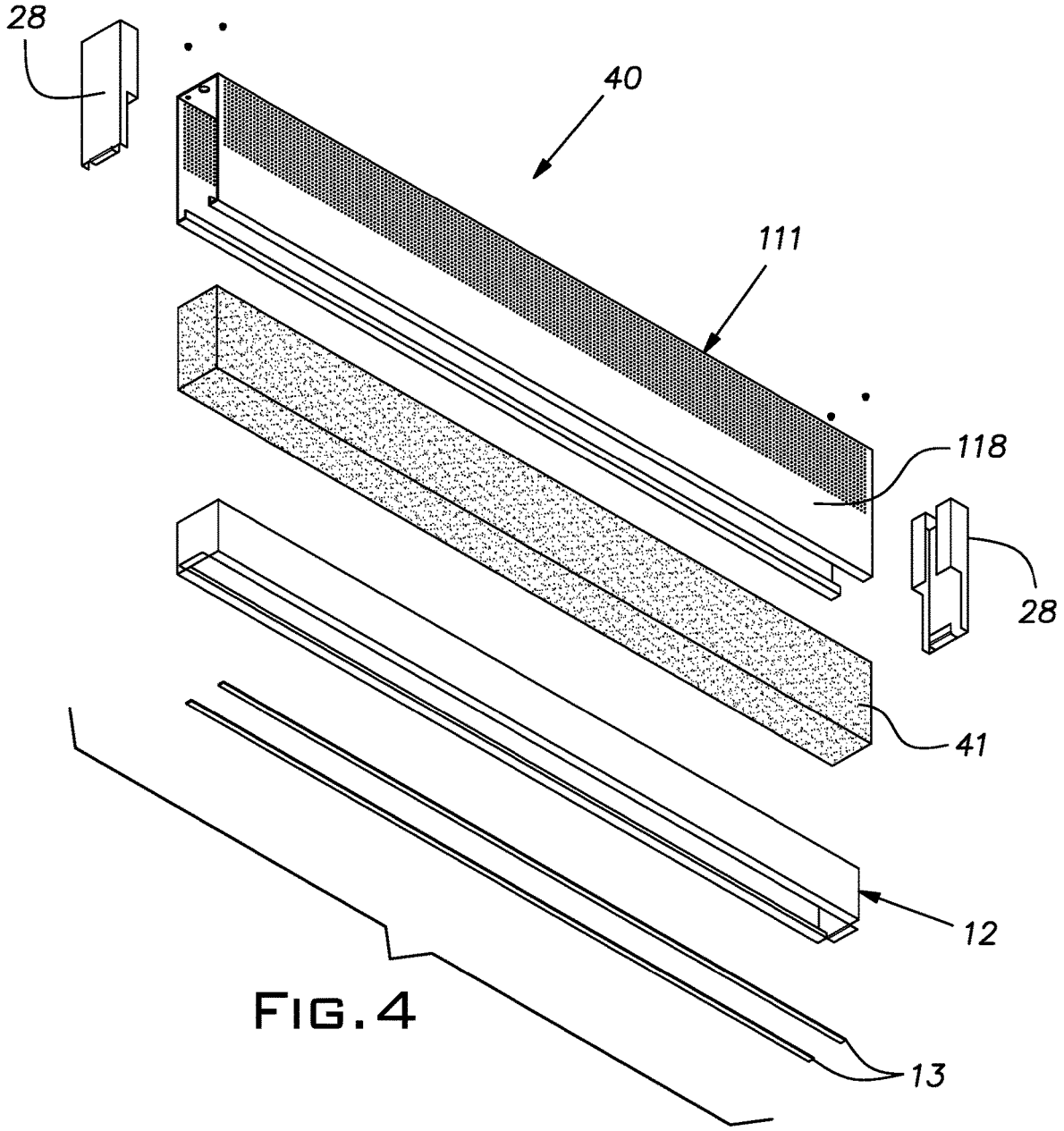
FIG. 4 is an isometric exploded view of a second embodiment of a light bar assembly of the invention.
Figure 5:
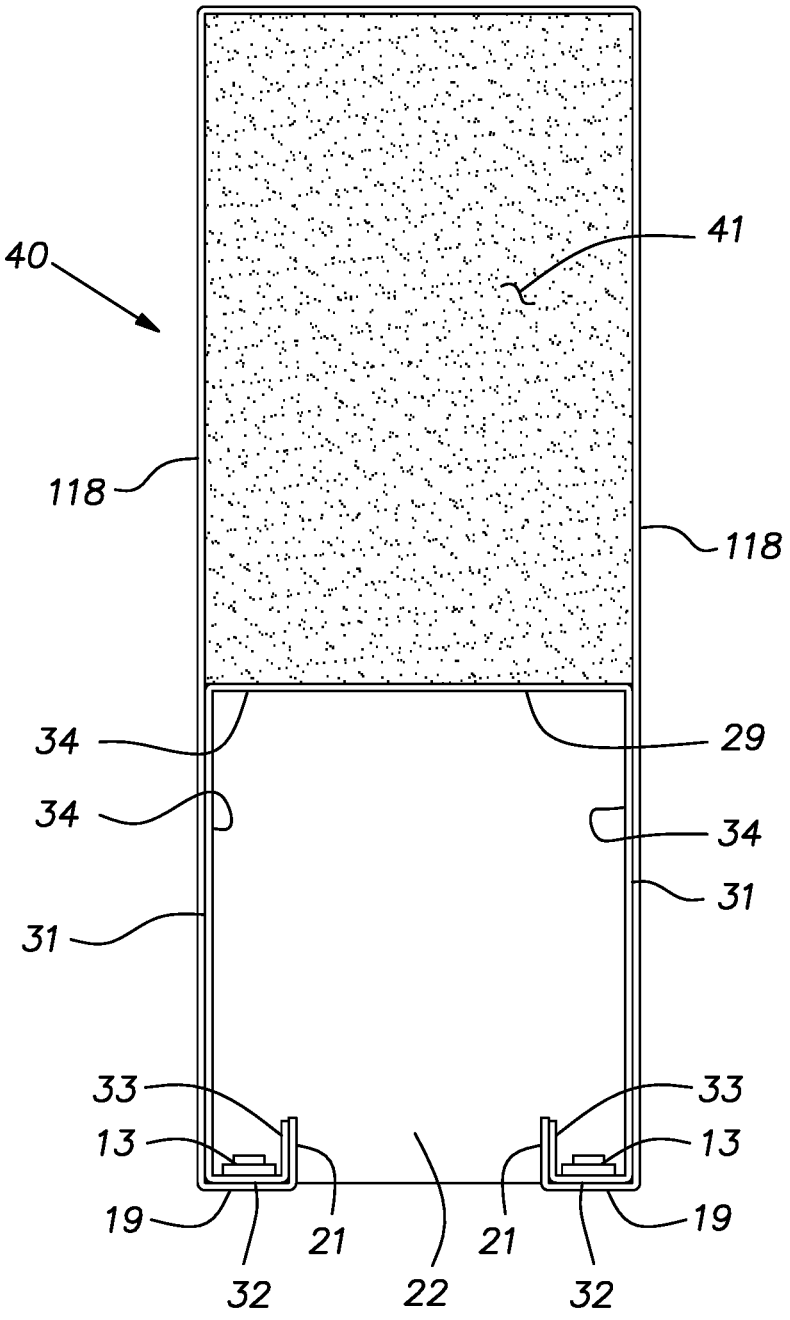
FIG. 5 is a cross-sectional view of the light bar assembly of the second embodiment.

FIGS. 4 and 5 illustrate a second embodiment of a light bar 40 that has acoustical absorption properties. Elements of the light bar 40 that are identical or equivalent to those of the first described embodiment are identified with the same reference numerals. Those elements that are analogous to those of the first-described light bar 10 are designated with a number that is 100 units greater. A housing 111 of the light bar 40 has upper portions of its sidewalls 118 perforated with circular holes of a diameter of 1/16 inch, for example and a total open area of 10%. The perforated zone can be slightly more than half of the height of the sidewall 118. Disposed within the housing is a sound absorbing medium 41, typically a porous non-woven batt, known in the art. The batt 41 preferably fills the space in the housing 111 above the light channel 12. The light bar 40 operates optically as the previously described light bar 10. The perforations of the sidewall 118 admit sound energy into the sound absorbing material or batt 41 to enhance the acoustical properties of the baffle-like light bar 40.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. For example, the housing and/or the light channel can have a cross-section that is not rectangular such as a trapezoid, or other polygon or can be curvilinear such as partial circle, ellipse, parabola or the like each with a suitable gap and light shield to take the place of the flanges 21. The light channel can be eliminated altogether where the coating 34 is applied to the interior of the housing. Accordingly, the patent is not to be limited in scope and effect to the specific embodiments herein shown and described nor in any other way that is inconsistent with the extent to which the progress in the art has been advanced by the invention.

What is claimed is:

1. An elongated lighting assembly useful in suspended baffle ceilings comprising an inverted channel having an upper web and opposed legs depending from opposite sides of the web, the depending legs being longer than a width of the upper web, inturned flanges integral with the legs extending inwardly from lower ends of the legs, distal edges of the inturned flanges having integral upstanding portions being horizontally spaced from each other to form a gap, an LED tape located over an upper surface of the inturned flanges and carrying upwardly facing LED elements at regularly spaced intervals, surfaces inside the channel facing the LED tape including inside surfaces of the depending legs adjacent the LED elements being coated with a white diffuse reflecting material whereby light emitted by the LED elements emanates essentially exclusively out of the gap by diffuse reflection from the coating, the configuration of the baffle enabling the baffle to be suspended with like baffles with or without LED elements in a parallel array to provide a ceiling boundary that can reduce noise and afford integrated overhead lighting to an underlying space.

2. An elongated light assembly as set forth in claim 1, wherein the upstanding portions of the inturned flanges have a height at least equal to the height of the LED elements such that the flanges obstruct a direct view of the LED elements from an observer below the light assembly.

3. An elongated light assembly as set forth in claim 2, wherein lengths of LED tape are disposed on each of said inturned flanges.

* * * * *